US006751817B1

(12) United States Patent
Leach

(10) Patent No.: US 6,751,817 B1
(45) Date of Patent: Jun. 22, 2004

(54) CONTOURED BODY PILLOW

(76) Inventor: Jamie S. Leach, 130 E. 10th St. P.O. Box 717, Ada, OK (US) 74820

( * ) Notice: Subject to any disclaimer, the term of this patent is extended or adjusted under 35 U.S.C. 154(b) by 0 days.

(21) Appl. No.: 10/428,950

(22) Filed: May 2, 2003

(51) Int. Cl.[7] ..... A47C 20/00
(52) U.S. Cl. ..... 5/632; 5/652; 5/657; 5/630
(58) Field of Search ..... D6/601; 5/632, 5/630, 636, 652, 657

(56) References Cited

U.S. PATENT DOCUMENTS

| | | | | |
|---|---|---|---|---|
| D201,492 | S | | 6/1965 | Jacobson |
| 4,173,048 | A | | 11/1979 | Varaney |
| 4,624,021 | A | | 11/1986 | Hofstetter |
| D303,897 | S | | 10/1989 | Phillips |
| 5,097,551 | A | | 3/1992 | Smith |
| 5,519,906 | A | | 5/1996 | Fanto-Chan |
| D377,881 | S | | 2/1997 | Watt |
| D382,435 | S | | 8/1997 | Schaffner |
| D409,038 | S | * | 5/1999 | Rojas et al. ..... D6/601 |
| 5,978,990 | A | | 11/1999 | Akey |
| 5,987,674 | A | | 11/1999 | Schaffner |
| 6,052,848 | A | | 4/2000 | Kelly |
| 6,088,854 | A | | 7/2000 | Brownrigg |
| D431,745 | S | * | 10/2000 | Jackson ..... D6/601 |
| D453,653 | S | * | 2/2002 | Tunnell ..... D6/601 |
| 6,499,164 | B1 | | 12/2002 | Leach |

* cited by examiner

*Primary Examiner*—Teri Pham Luu
(74) *Attorney, Agent, or Firm*—William S. Dorman

(57) ABSTRACT

A contoured body pillow adapted to permit unlimited positioning options to facilitate relief from persistent back and neck pain, respiratory and digestive disorders, and to provide a sensation of closeness, comfort and security by conforming to the body of a user, thereby permitting the user to sleep comfortably through the night, the contoured body pillow having a substantially candy cane shape comprising a first terminal end having a semi-bell shape connecting to a U-shaped portion, a downwardly extending leg connecting to the U-shaped portion, the leg expanding at its lowermost portion to form a bell shape, the bell shape terminating at a second terminal end in a beveled edge.

7 Claims, 3 Drawing Sheets

CONTOURED BODY PILLOW

BACKGROUND OF THE INVENTION

1. Field of the Invention

The present invention relates to a body pillow. More particularly, the present invention involves a contoured body pillow having a substantially candy cane shape with a semi-bell-shaped rounded top portion adapted to accommodate the upper front torso portion of a person, a U-shaped curved portion adapted to accommodate the head, a downwardly extending leg adapted to accommodate the back and rear torso, and a beveled bell-shaped bottom for accommodating the lower portion (legs) of the person.

2. Prior Art

There are a number of patents that show or relate to support pillows. Some of the support pillows are designed particularly for infants, some particularly for small children and some especially for adults. It is believe to be novel to provide a contoured body pillow with a substantially candy cane shape for optimal body support in a resting position. A preliminary patentability search was conducted on this invention and the following listed references were uncovered in the search.

| Patent No. | Name | Date |
|---|---|---|
| 6,499,164 B1 | Leach | Dec. 31, 2002 |
| Des. 382,435 | Schaffner, et al. | Aug. 19, 1997 |
| 6,088,854 | Brownrigg | Jul. 18, 2000 |
| 5,987,990 | Akey | Nov. 9, 1999 |
| 5,519,906 | Fanto-Chan | May. 28, 1996 |
| 6,052,848 | Kelly | Apr. 25, 2000 |
| Des. 201,492 | Jacobson | Jun. 29, 1965 |
| 5,987,674 | Schaffner, et al. | Nov. 23, 1999 |
| 5,097,551 | Smith | Mar. 24, 1992 |
| 4,624,021 | Hofstetter | Nov. 25, 1986 |
| 4,173,048 | Varaney | Nov. 6, 1979 |
| Des. 377,881 | Watt | Feb. 11, 1997 |
| Des. 303,897 | Phillips | Oct. 10, 1989 |

The above patents are not considered to be particularly pertinent to the present invention. Applicant's U.S. Pat. No. 6,499,164 B1 appears to be the most relevant of the prior art patents. However, the present invention is substantially different from U.S. Pat. No. 6,499,164 B as will hereinafter appear.

U.S. Des. Pat. No. 382,485 to Schaffier discloses a long pillow comprising a straight portion provided with a slight curvature at one end and circular indentations located in central spaced relation along the length of the pillow. U.S. Des. Pat. No. 201,492 to Jacobson discloses a J-shaped pillow. The Brownrigg U.S. Pat. No. 6,088,854 discloses an ultra-flexible pillow for medical applications which appears to be designed for use in hospitals and which is limited in its claims to a diameter of 4.5 inches and which does not satisfy the cooling feature of the present invention. Akey U.S. Pat. No. 5,978,990 discloses a comfort maternity pillow comprising a rectangular pillow having two arms extending therefrom to form a sort of pear shape having a central opening therein. Fanto-Chan U.S. Pat. No. 5,519,906 discloses a horseshoe shaped pillow having two legs extending therefrom. Kelly U.S. Pat. No. 6,052,848 discloses an elongated U-shaped pillow which may be of various lengths and the shape of which is easily adjustable for a variety of uses. Smith U.S. Pat. No. 5,097,551 discloses a segmented, elongated body pillow. Hofstetter U.S. Pat. No. 4,624,021 discloses an elongated pillow.

SUMMARY OF THE INVENTION

A contoured body pillow having a substantially candy cane shape with a semi-bell-shaped portion connected to a U-shaped portion which transitions into a downwardly extending leg terminating in a beveled bell-shaped portion. The semi-bell-shaped top portion of the pillow consists of a short, fat pillow provided with a wide, rounded terminating end. A non-terminating end of the semi-bell-shaped top portion tapers upwardly and convergingly inward and curves to form a U-shaped portion, which U-shaped portion then transitions into an elongated leg, the elongated leg tapering divergently outward at its lower end to form a bell shape, the bell shape terminating in a beveled edge.

The contoured body pillow of the present invention is intended to permit unlimited positioning options to facilitate relief from persistent back and neck pain, respiratory and digestive disorders, and to provide a sensation of closeness, comfort and security by conforming to the body of a user, thereby permitting the user to sleep comfortably through the night.

DETAILED DESCRIPTION OF THE PREFERRED EMBODIMENTS

Figure 1:
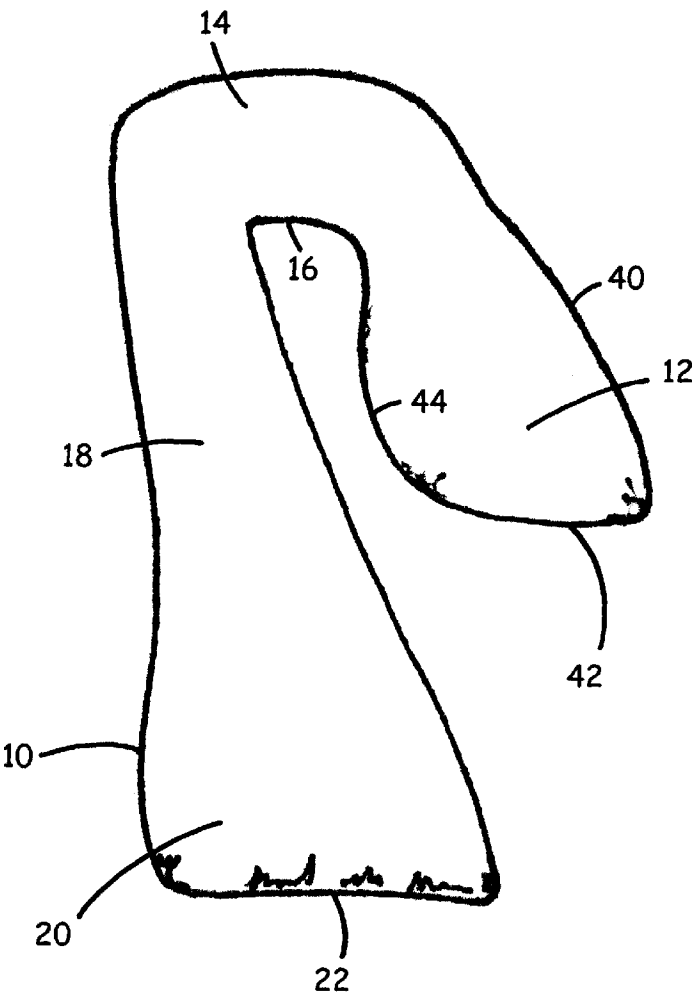
FIG. 1 is a perspective view of the top of the pillow of the present invention.

Referring to the drawings in detail, FIG. 1 shows a contoured body pillow 10 comprising a substantially candy cane shape, the contoured body pillow 10 having a semi-bell-shaped member 12 which forms a first terminal end of the contoured body pillow 10 and which tapers upwardly and convergingly inward at an opposite non-terminal end and which semi-bell-shaped member 12 transitions at the opposite non-terminal end into a U-shaped portion 14 having an outer perimeter edge (not numbered) and an inner perimeter edge 16 which inner perimeter edge forms a well, the U-shaped portion transitioning at a side opposite the semi-bell-shaped member 12 into a downwardly extending leg 18 having an upper end and a lower end (not numbered), the downwardly extending leg 18 being slightly longer than the semi-bell-shaped member 12 and the downwardly extending leg 18 transitioning at its lower end (not numbered) into an outwardly expanding bell shape portion 20 terminating in a beveled edge 22. The semi-bell shaped member 12 of the body pillow 10 is asymmetrical and has straight outer portion 40, a rounded terminal edge 42, and a curved inner portion 44 which is adapted to support the lower back or stomach area of an adult user 24 (see FIGS. 2 and 3). The inner perimeter edge (or well) 16 of the U-shaped portion 14 curves slightly inward to conform to the curvature of an adult body. The downwardly extending leg 18 is narrow at the upper end thereof and gradually widens until it reaches the lower end thereof (not numbered), where the downwardly extending leg 18 flares outwardly to form the substantially symmetrical bell shaped portion 20 which achieves a width of approximately eighteen inches at the terminal end thereof or beveled edge 22.

Figure 2:
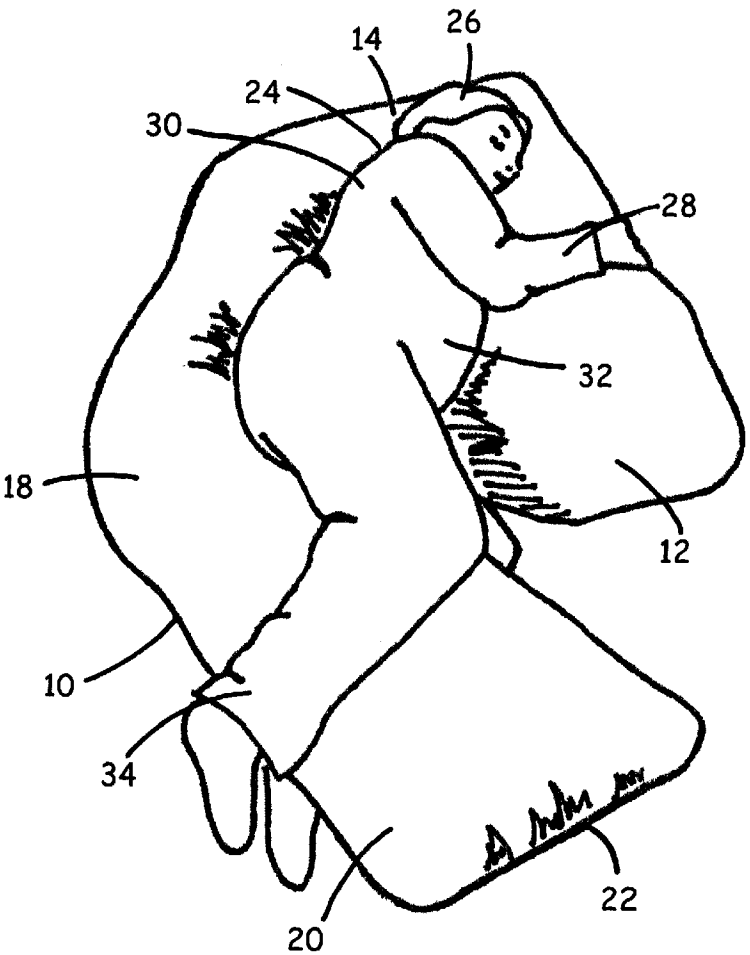
FIG. 2 is a perspective view of an adult woman lying on her side within the pillow of FIG. 1 showing the woman's arms wrapped around the semi-bell-shaped upper portion and her legs supported by the lower beveled bell-shaped bottom portion of the pillow.

FIG. 2 shows a contoured body pillow 10 employed in supporting an adult female 24 who is lying on her side. When the adult female 24 is in this position, her head 26 will rest against the U-shaped portion 14 of the pillow, the semi-bell shaped portion 12 is received between her arms 28, and the bell shaped portion 20 is received between her legs 34.

Figure 3:
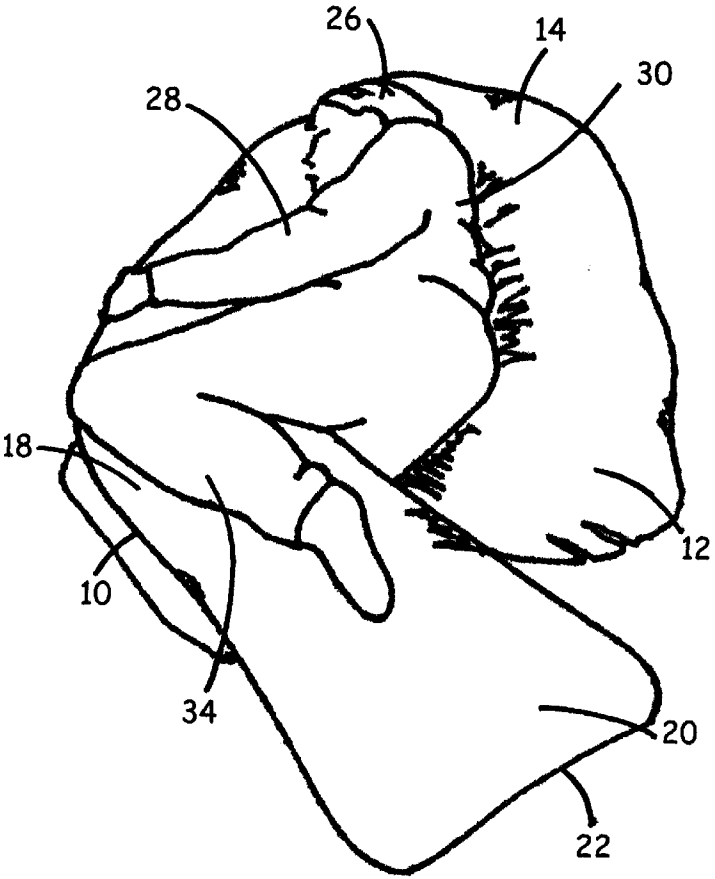
FIG. 3 is a perspective view similar to FIG. 2 but showing the woman in the reverse position of that shown in FIG. 2.

FIG. 3 shows a contoured body pillow 10 employed in supporting an adult female 24 who is lying on her side, but who is facing the opposite direction of the adult female shown in FIG. 2. When the adult female 24 is in this position, her head 26 will rest against the U-shaped portion 14 of the pillow, the semi-bell shaped portion 12 is received against her back 30, the downwardly extending leg 18 is received between her arms 28, and the bell shaped portion 20 is received between her legs.

Figure 4:
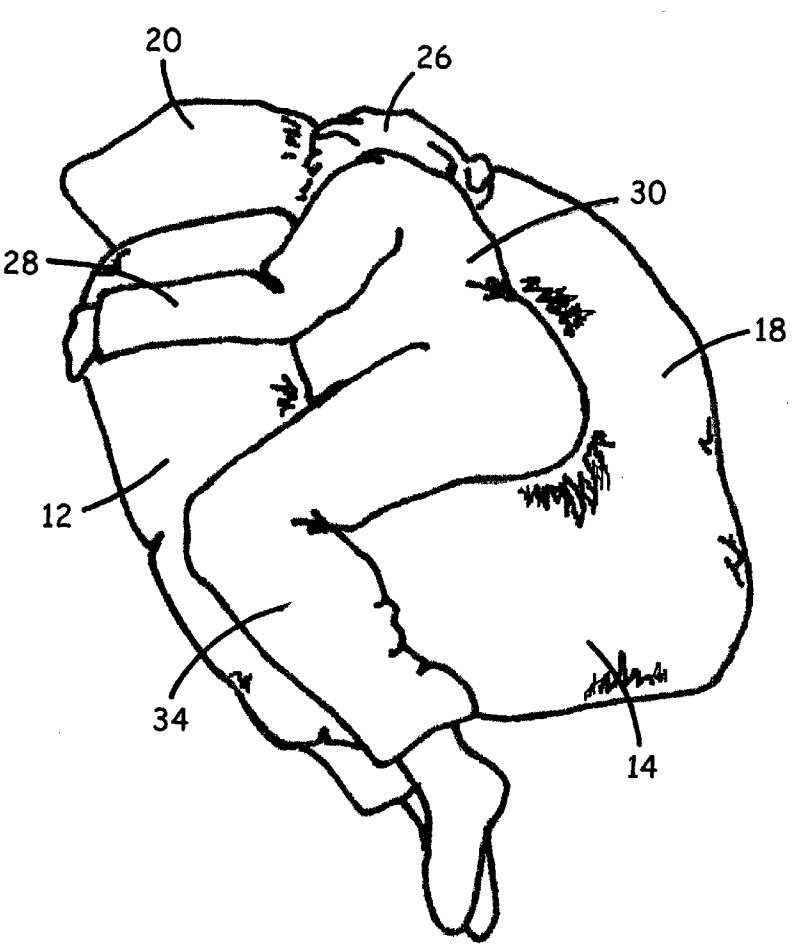
FIG. 4 is a perspective view similar to FIGS. 2 and 3 but showing the pillow rotated approximately 180° and "flipped over" to produce a mirror image with the pillow being fully enclosed around the woman's body.

FIG. 4 shows a contoured body pillow 10 employed in supporting an adult female 24 who is lying on her side, similar to FIGS. 2 and 3, but who has situated the contoured body pillow 10 substantially upside-down and brought the semi-bell shaped portion 12 and the bell shaped portion 20 into contact with each other to provide the sensation of "closeness." When the adult female 24 is in this position, her head 26 will rest against the bell shaped portion 20 of the contoured body pillow 10, the downwardly extending leg 18 will be received against her back 30, the U-shaped portion 14 will be received between her legs 34, and the semi-bell shaped portion will be received against her torso 32 and between her arms 28.

Figure 5:
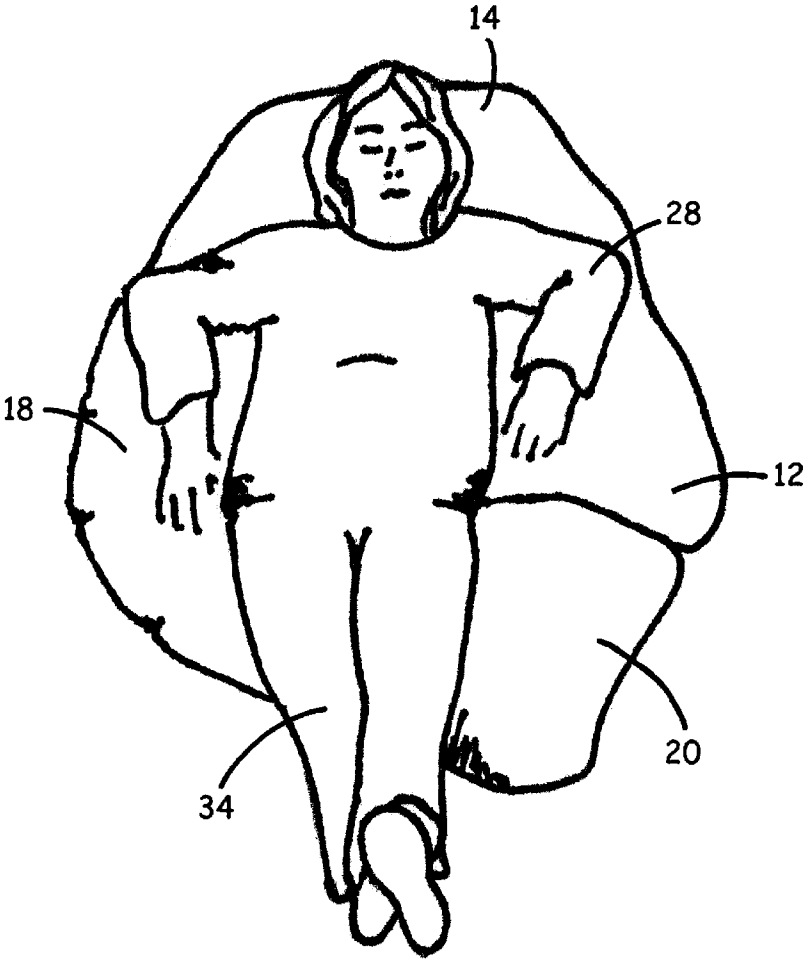
FIG. 5 is a perspective view similar to FIGS. 2, 3 and 4 but showing the pillow fully enclosed around the woman lying in a supine position.

FIG. 5 shows a contoured body pillow 10 employed in supporting an adult female 24 who is lying on her back (not shown in this Figure) and who has situated the contoured body pillow 10 substantially upside-down and brought the semi-bell shaped portion 12 and the bell shaped portion 20 into contact with each other to provide the sensation of "closeness." When the adult female 24 is in this position, her head 26 will rest against the U-shaped portion 14 of the contoured body pillow 10, the semi-bell shaped portion 12 and the downwardly extending leg 18 are received under her arms 28, provide support to her torso 32 and back (not shown), and the bell shaped portion 20 is received under her legs 34 to alleviate pressure on her spine (not shown).

Figure 6:
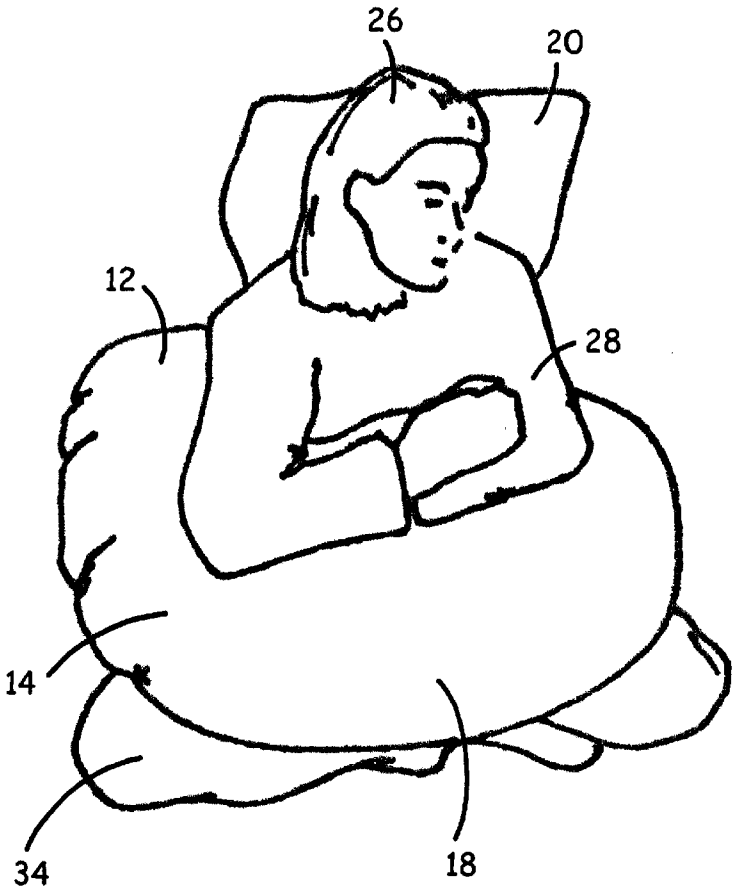
FIG. 6 is a perspective view showing a woman seated with the pillow of the present invention wrapped around her mid-section and showing the lower beveled bell-shaped bottom portion extending upward behind the woman while she holds an infant.

FIG. 6 shows a contoured body pillow 10 wrapped around the torso 32 of an adult female and extending upward against her back 30 for support when reading, holding an infant, or similar activity. It should be noted that the contoured body pillow 10 must be propped against a wall, headboard or similar surface (not shown) to achieve this position. When the adult female 24 is in this position, her head 26 and back (not shown) will rest against the bell shaped portion 20 of the contoured body pillow 10, while the downwardly extending leg 18, the U-shaped portion 14, and the semi-bell shaped portion 12 wrap around her torso 32 and rest on top of her legs 34.

That is, FIG. 2 shows the body pillow 10 of FIG. 1 being bent at approximately location 18 with the adult female 24 having the semi-bell shaped portion 12 tucked under her arm and the bell shaped portion 20 received between her legs. FIG. 3 shows the user facing the opposite direction from her position in FIG. 2 while maintaining the body pillow 10 in substantially the same position shown in FIG. 2, the adult female 24 having the downwardly extending leg 18 received between her arms 28, the semi-bell shaped portion 12 received against her back and conforming thereto, and the bell shaped portion 20 received between her legs. FIG. 4 shows the body pillow 10 wrapped around the body of the adult female 24 with the semi-bell shaped portion 12 being received between the arms 28 of the adult female 24, the downwardly extending leg of the pillow being received against the back 30 of the adult female 24, the U-shaped portion 14 being received between the legs 34 of the adult female 24, and the head 26 of the adult female 24 being supported by the bell shaped portion 20. FIG. 5 shows the body pillow 10 supporting an adult female (not numbered in this Figure) in the supine position, the legs 34 of the adult female being supported by the bell shaped portion 20, the bell shaped portion 20 being in direct contact with the semi-bell shaped portion 12, the arms 28 of the adult female being supported by the semi-bell shaped portion 12 and the downwardly extending leg 18, and the head of the adult female being supported by the U-shaped portion 14. FIG. 6 shows the body pillow being wrapped around the torso of the adult female with the bell shaped portion 20 extending behind the back (not numbered) and head 26 of the adult female to provide cushion and support when the adult female is resting against a headboard, wall, or other surface, the semi-bell shaped portion 12, downwardly extending leg 18, and U-shaped portion 14, wrapping around the torso of the adult female with the legs 34 of the adult female below the body pillow and the arms 28 of the adult female resting thereon. Therefore, the body pillow 10 of the present invention is malleable and is capable of being shaped, bent, or drawn out depending upon the desires of the user.

While FIGS. 2 through 6, inclusive, depict the various positions which may be achieved with the contoured body pillow 10 of the present invention, it should be apparent that other and further modifications of the present invention, apart from those shown or suggested herein, may be made within the spirit and scope of this invention.

What is claimed is:

1. A contoured body pillow having a substantially candy cane shape, which shape is malleable and may be altered to form a plurality of different shapes conforming to the desires of the user, comprising a first terminal end having a semi-bell shape which tapers upward and convergingly inward at an opposite non-terminal end the semi-bell shaped member having a substantially straight outer edge and a substantially curved inner edge, the semi-bell shape member transitioning at the non-terminal end into a U-shaped portion, a downwardly extending leg connecting to the U-shaped portion, the downwardly extending leg having an initially narrow construction gradually widening and the leg expanding at its lowermost portion to form a bell shape, the bell shape terminating at a second terminal end in a beveled edge.

2. A contoured body pillow as set forth in claim 1 wherein the length of the downwardly extending leg is slightly greater than the length of the semi-bell shaped first terminal end.

3. A contoured body pillow as set forth in claim 1 wherein the head of an adult person, lying on her side, is adapted to rest against the U-shaped portion and wherein the semi-bell shaped portion is adapted to be received between the arms or legs of the person and wherein the bell shaped portion is adapted to be received between the legs of the person.

4. A contoured body pillow as set forth in claim 1 wherein the head of an adult person, lying in the supine position, is adapted to rest against the U-shaped portion and wherein the semi-bell shaped portion may be brought into contact with the bell shaped portion to create a well adapted to receive the upper torso of the person, the semi-bell shaped portion and downwardly extending leg are adapted to support the arms of the person, and wherein the bell shaped portion is adapted to support the legs of the person.

5. A contoured body pillow as set forth in claim 1 wherein the head of an adult person, lying on her side, is adapted to rest against the bell shaped portion, wherein the U-shaped portion is adapted to be received between the legs of the person, and wherein the semi-bell shaped portion is adapted to be received between the arms of the person.

6. A contoured body pillow as set forth in claim 1 wherein the head of an adult person, lying on her side, is adapted to rest against the U-shaped portion and wherein the downwardly extending leg is adapted to be received between the arms of the person and wherein the bell shaped portion is adapted to be received between the legs of the person.

7. A contoured body pillow as set forth in claim 1 wherein the bell shaped portion is adapted to be received against the back of a seated adult person and wherein the downwardly extending leg, U-shaped portion, and semi-bell shaped portion are adapted to surround the torso of the person.

* * * * *